United States Patent [19]

Balint

[11] Patent Number: 4,817,408

[45] Date of Patent: Apr. 4, 1989

[54] METHOD AND MACHINE FOR FABRICATING ROTATION BODIES BY PLASTIC DEFORMATION

[76] Inventor: Ludwig Balint, Bregenzer Strasse 37, A-6911 Lochau, Austria

[21] Appl. No.: 170,039

[22] Filed: Mar. 11, 1988

Related U.S. Application Data

[63] Continuation of Ser. No. 881,041, filed as PCT AT85/00041 on Oct. 15, 1985, published as WO86/02296 on Apr. 24, 1986, abandoned.

[30] Foreign Application Priority Data

Oct. 19, 1984 [AT] Austria ..... 3345/84
Oct. 19, 1984 [AT] Austria ..... 3346/84

[51] Int. Cl.[4] ..... B21H 1/22

[52] U.S. Cl. ..... 72/92; 72/94; 72/95

[58] Field of Search ..... 72/88, 90, 91, 92, 93, 72/94, 95, 101, 103, 104, 108, 110, 111, 184, 190

[56] References Cited

U.S. PATENT DOCUMENTS 425,516 4/1890 Leavy ..... 72/103
2,060,087 11/1936 Klamp ..... 72/103

*Primary Examiner*—Lowell A. Larson
*Attorney, Agent, or Firm*—Kurt Kelman

[57] ABSTRACT

A process and machine for fabricating a rotation body having different diameters along the length thereof is disclosed, in which a blank is rotated and worked between two pressure zones to apply thereto a local pressure exceeding the flow limit of the blank material whereby circularly extending impressions of the different diameters are worked into the blank, the pressure zones crossing each other. The pressure zones are displaced relative to each other while applying the local pressure, the displacement motion having a component extending in the longitudinal direction of at least one of the pressure zones and the points of intersection of the crossing pressure zones forming a geometric line, and the blank is displaced in dependence on this line and on the different diameters to be produced.

22 Claims, 11 Drawing Sheets

Fig. 1
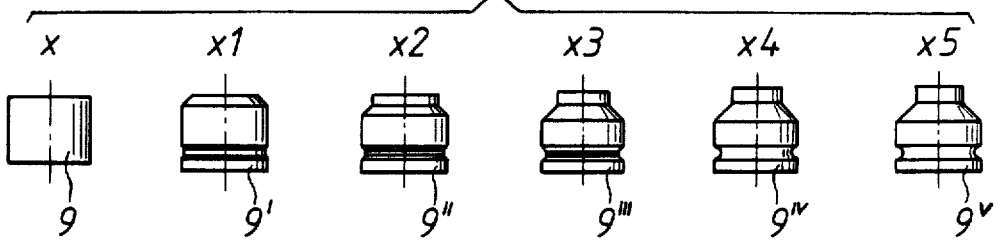
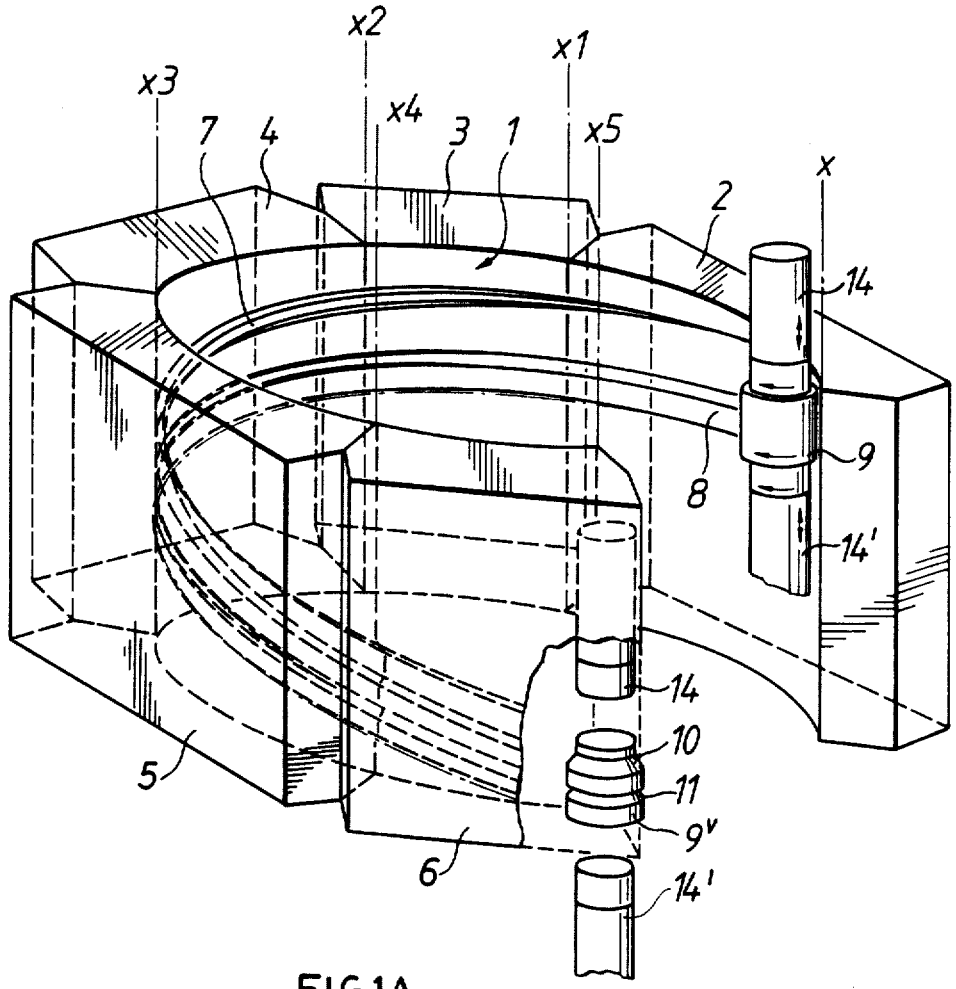
FIG.1A 81
2,3,4,5,6
81
90
96
12
14
81
82
88
9
74
69
81
81
103
99
101
102
98
104
105
100
9
93
106
97
9v
107
108
109
110
113
111
112
114
115

71
70
14
140
142
141
142
58
134
92
127
56
9
14'
131
55
130
128
127
47

METHOD AND MACHINE FOR FABRICATING ROTATION BODIES BY PLASTIC DEFORMATION

This is a continuation of my copending application Ser. No. 881,041, filed as PCT AT85/00041 on Oct. 15, 1985, published as WO86/02296 on Apr. 24, 1986, now abandoned.

The invention relates to a process for fabricating rotation bodies having varying diameters across their length, in which process a pressure exceeding the flow limit of the material of the blank is locally applied while the blank is being rotated, and the blank is deformed.

In most processes of said type which have become known to date, two parallel extending pressure zones are used, between which zones the blank is worked For said purpose, two counterrotatably drivable rolls provided with profiled ribs are used in most cases, with a gap remaining between said rolls. In said process, the blanks are passed through the roll gap substantially crosswise with respect to the rolls which, in most cases, are arranged crossed by a small amount of angle, which results in the drawback that an almost abruptly starting and only very briefly acting pressure zone is produced, said pressure zone being determined by the profiled ribs.

Furthermore, for fabricating threaded bolts, it has been proposed earlier to deform the blank between two parallel extending pressure zones, said pressure zones being determined by profiled ribs arranged on a roll and a counteracting pressure surface cooperating with said roll. However, owing to the fact that the counteracting surface cannot be reset with respect to the roll, no sufficient accuracy can be achieved for the finished rotation bodies over a longer period of time.

The objective of the invention is to avoid said drawbacks of the known methods and to propose a process that is universally suitable for fabricating differently shaped rotation bodies, and wherein the application of pressure can be changed gradually.

According to the invention, said objective is achieved by working the blank between two pressure zones which cross each other, whereby the pressure zones are moved relative to each other and the blank is displaced in dependence on the line established by the points of intersection in the relative motion of the pressure zones, and the variations in diameter to be produced.

Owing to the relative motion of the pressure zones crossing each other and to the way in which the blanks are guided it is possible to fabricate from said blanks rotation bodies of any desired shape, and to permit the pressure zones to act on the blank for a longer period of time For fabricating rotation bodies with grooves extending around said bodies, it may be usefully provided that the blanks are displaced substantially parallel to the points of intersection of the pressure zones resulting from the relative motion of said pressure zones.

For manufacturing rotation bodies with spirally extending grooves such as, for example, threads, however, it may be provided that the angle at which the blanks are displaced with respect to the line conforming to the geometric site or location of the points of intersection of the pressure zones while said pressure zones perform their relative motion conforms to the angle of pitch of the spirally extending groove to be produced, a blank preferably having the outside diameter of the desired thread being used.

When using blanks having the outside diameter of the thread, in particular of trapezoidal threads or the like, the advantage is that for completely building up the ribs of the thread, the material is not required to plastically flow up the flanks of the thread, which possibly could lead to overstressing of the material and cracks on the generated surface of the ribs of the thread, but only flow axially, which assures that the ribs of the thread consist of full material and cannot have any hollow spaces or cracks covered by outwardly displaced material However, for fabricating rotation bodies with at least two segments of different diameters, it is advantageous if the pressure zones intersecting each other are at least in sections more narrow than the segment of the rotation body to be fabricated, said segment having a smaller diameter, and if the blanks are displaced inclined against the line conforming to the geometric location of the points of intersection of the pressure zones while said zones perform their relative motion.

It is another objective of the invention to propose a device for carrying out the process of the invention. For a device comprising a roll and a counteracting pressure surface cooperating with said roll, said roll and said surface being capable of being displaced relative to each other, and in which device at least one projecting profiled rib is disposed each on the roll and the counteracting pressure surface, it is proposed that according to another feature of the invention, the profiled ribs are arranged crossing each other, and that there is provided for the blanks a guide extending based on the line determined by the points of intersection of the profiled ribs while the roll is rotating. The pressure zones crossing each other are safely established and secured by said measures in a very simple manner. The course of the guide for the blank may be selected with respect to the course of the points of intersection of the profiled ribs resulting during the rotation of the roll depending on the rotation body to be fabricated.

For fabricating rotation bodies with grooves extending around said bodies, it may be provided that the guide extends substantially parallel to the lines determined by the points of intersection of the profiled ribs while the roll is rotating, whereby the counteracting surface is preferably divided in segments which can be radially displaced with respect to the roll. In this way, the profiled ribs are acting on the blank in substantially always the same axial position throughout the entire treatment of the blank. Minor deviations in parallelism between the guide and points of intersection of the profiled ribs resulting during rotation of the roll may be provided in order to take into account the growth in length of the blank being worked, said growth being caused by the working of a groove or by reducing the diameter in sections, or in order to strengthen the walls of the ribs.

With a counter surface divided in segments, the profiled ribs crossing each other permit said counteracting surface to be set more or less spaced from the roll. This is possible owing to the fact that in the extreme case, the profiled ribs crossing each other can come into contact with each other only along a surface line. This, however, is not possible in the known devices with parallel extending profiled ribs because in this case, any change in the radial position of the counteracting surface would cause a gap between the cooperating surfaces of the profiled ribs that changes across the length of the arc.

However, for producing rotation bodies with spiral grooves, it is advantageous if the angle at which the guide extends with respect to the line determined during rotation of the roll by the points of intersection of the profiled ribs, conforms to the pitch of the groove to be fabricated. By virtue of the fact that the angle between the course of the guide and line determined during rotation of the roll by the points of intersection of the profiled ribs conforms to the pitch of the thread to be produced, it is possible to shape the thread in a very simple manner with profiled ribs conforming to only one thread rib Of course, the growth in length of the blank during impression of the groove has to be taken into account in this case as well if a blank having the outside diameter of the thread to be produced is used.

For fabricating rotation bodies with segments with at least two sections of different diameters, it may be provided that the guide extends inclined against the line determined during rotation of the roll by the points of intersection of the profiled ribs, whereby the difference in spacing between said line and the guide, said difference being caused by said inclination, is smaller than the width of the profiled rib over a distance conforming to one rotation of the blank, and the difference in the spacings of the guide from the line determined by the points of intersection, in the feeding zone of the blanks and take-off zone for the finished rotation bodies, conforming to the length of the section with the smaller diameter of the rotation body. By said measures it is achieved that a pressure is applied to the worked blanks not only in the radial direction, but in the axial direction, too, which facilitates the plastic deformation or flow of the material.

Furthermore, owing to the fact that the profiled ribs cross each other, it is possible, too, to fabricate bodies with a pointed end zone, or end zone extending in a streamlined form. For said purpose, it is necessary only to design the profiled ribs accordingly so that said profiled ribs come into contact with each other while being rotated reciprocally.

Furthermore, in a preferred embodiment of the invention, it may be provided that the segments of the counteracting surface are arranged on carriages slidably guided radially with respect to the center roll, said carriages preferably being displaceable independently from each other by means of a controlling drive. In said way, variations between the blanks with respect to both their dimensions and hardness or strength may be compensated in a very simple manner. Also, it may be provided that the controlling drive is acted upon by signals of an automatic measuring system for randomply checking or measuring the finished rotation bodies. In this way, the counteracting surface can be reset or adjusted in a way such that the finished rotation bodies are in the center range of the intended field of tolerance.

According to another feature of the invention, it may be provided that each of the profiled ribs of the center roll and counteracting surface, said profiled ribs crossing each other, extends inclined against the axle of the center roll. It is possible without any problems to arrange one of said profiled ribs, said ribs crossing each other, perpendicular to the axle of the center roll; however, in this case, in addition to performing the relative motion of rotation, the center roll and the counteracting surface have to perform also a relative motion having a component extending in the axial direction of the roll. Said additional motion can be dispensed with by arranging the profiled ribs of the roll and counteracting surface with an inclination against the axis of rotation of the roll.

Another objective of the invention is to propose an enhanced process for fabricating rotation bodies with different diameters at their two ends, or axial segments with varying diameters, wherein upon rotation of the blank, a pressure exceeding the flow limit of the material of such blank is locally applied while said blank is rotating around its longitudinal axis in order to reduce the diameter of the blank, as well as to propose a device for carrying out said process.

In the known processes of said type, a profiled rib arranged on a roll is impressed in the blank while said blank is being supported by a counteracting roll rotating in the opposite direction of rotation, the width of said profiled rib conforming to at least the length of the section of the blank whose diameter is to be reduced Practically, this means that the pressure is simultaneously applied to the total zone that is to be reduced in diameter.

However, this leads to the drawback that very high forces and thus great amounts of energy are required; furthermore, in said known process, it is relatively difficult for the material to begin to flow.

According to the invention, it is proposed that a pressure zonehaving a smaller dimension in the longitudinal direction of the blank as compared to the axial extension of the zone with the reduced diameter of the rotation body to be fabricated is displaced in the axial direction of the blank while said blank is rotating This can be achieved in a way such that a narrow or slim profiled rib is displaced across the blank in the axial direction while said blank is rotating. In this way, the material is forced to flow in the axial direction of the blank, which facilitates the deformation and requires only less force.

In any case, while the blank is locally treated with pressure, a component of force is acting on said blank in the axial direction as well, which significantly facilitates the action of flow or plastic deformation initiated by said pressure treatment.

In a device for carrying out said process variation of the process of the invention, said device having a roll cooperating with a counteracting surface and capable of being displaced relative to said counteracting surface, a projecting profiled rib arranged on the roll and/or on the counteracting surface, it is proposed according to another feature of the invention that the profiled rib(s) has/have a width smaller than the axial extension of the zone with the reduced diameter of the rotation body to be fabricated, and that a guide is provided for the blanks, said guide being inclined with respect to the profiled rib. In this way, the pressure zone is forced to move in the longitudinal direction of the blank.

In the fabrication of rotation bodies with grooves extending around said bodies, it may be desirable to additionally densify the body within the zone of the walls of the groove in some cases. In such a case, the controlling groove may be inclined against the imaginary line resulting from the course of the points of intersection of the profiled ribs of the center roll and counteracting pressure surface. In this way, the profiled ribs apply pressure to the blank not only radially, but also on the walls of the groove forming in the axial direction.

In said connection, it may be provided according to another feature of the invention that the profiled rib(s) arranged on the center roll and the profiled rib (s) arranged on the counteracting pressure surface, said surface preferably being divided in a plurality of segments capable of being radially adjusted with respect to the roll, extend inclined against the axis of rotation of the roll and cross each other in the course of their relative motion, and that a guide is provided for the blanks, said guide extending inclined with respect to the line determined by the points of intersection established during rotation of the roll by the corresponding edges of the profiled ribs so that the spacing between said line and the guide caused by said inclination is smaller than the width of the profiled rib by a distance conforming to one rotation of the blank, and that the difference in the spacings of the guide from the line determined by the points of intersection, in the feed zone of the blanks and in a take-away zone for removing the finished rotation bodies, conforms to the length of the section having the smaller diameter of the rotation body. In this way, it is assured that the thin or slim profiled ribs for the grooves or sections to be fabricated with a reduced diameter are displaced or moved across the blank in the axial direction without shaping or forming spiral grooves by said motion. However, owing to said axial motion or displacement, the flanks of the profiled ribs exert pressure on the walls of the groove to be fabricated, or on the shoulder of the section to be produced with a reduced diameter, in the axial direction, leading to a compression of the material in said zone.

According to another feature of the invention, in order to assure that the blanks are exactly carried along and guided during their treatment between the center roll and counteracting pressure surface, it may be provided that the guide is formed by a driving device consisting of at least one, preferably, however, two rotary bodies spaced apart from each other in the axial direction of the center roll, in which rotary body or bodies tappets are supported, which tappets are displaceable in their longitudinal direction and engage a controlling groove by means of a sliding block, said controlling groove being arranged in a stationary part of the device and extending around said part so that tappets guided in two different rotary bodies are aligned axially relative to each other and substantially parallel to the axis of rotation of the roll, and the blanks can be clamped or chucked by at least one tappet, preferably, however, between two tappets in order to be driven. By said measures, the blanks are chucked and thus taken along or driven between the tappets and a coulisse, but better yet between two tappets, said tappets being axially aligned with each other. In said arrangement, it may be readily provided that the controlling groove(s), with the exception of a feeding zone for the blanks and take-away zone for the finished rotation bodies, extend substantially parallel to each other, which assures exact guidance of the blanks and simple feeding of the blanks as well as discharge of the finished rotation bodies. A slight variation in parallelism for compensating lengthwise growth of the blank during processing may be provided with said arrangement.

Furthermore, in a preferred embodiment of the device according to the invention, it is provided that at least the end zones of the tappets facing each other are supported rotatable around the longitudinal axis of the tappets, whereby preferably the end zones of the tappets are spring-loaded against the coaxially aligned tappets. In this way, friction is avoided between the face sides of the blanks and the tappets. By resiliently supporting the end zones of the one set of tappets, excessive pressing of the blank being processed is avoided if said blank grows in the axial direction, for example due to the groove being impressed in it, or due to a reduction of the diameter. In addition, dimensional variations of the blanks may be compensated in this way. The end zones of the tappet may be formed by inserts.

According to another feature of the invention, it may be provided that a toothed rim is provided for the driving device, said toothed rim being torsionally rigidly connected with the center roll and engaged by gearings drivingly connected with supporting shafts, said shafts being arranged parallel to the tappets so that the supporting shafts are supported in the rotary bodies guiding the tappets, or torsionally rigidly connected with said rotary bodies, and the circumferential speeds of the center roll and blanks may be adjusted to each other by adapting the gearings accordingly.

The invention is explained in greater detail in the following with the help of the drawing, in which:

FIGS. 1A and 1B are schematic views of tools for carrying out the process of the invention, FIG. 1 showing the deformation of a blank with such tools;

Figure 1B:
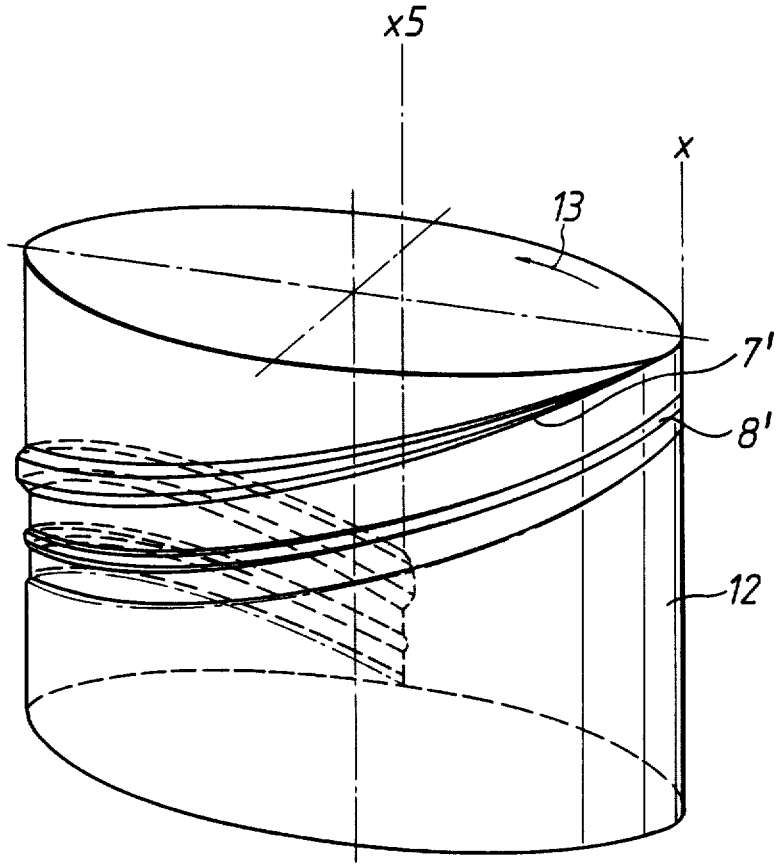

FIG. 1A shows a schematic view of the profiled ribs 7 and 8 arranged on the counteracting pressure surface 1, said surface being divided in the five segments 2, 3, 4, 5 and 6. Of said profiled ribs 7 and 8, the profiled rib 7 serves for shaping the step or shoulder 10 of the finished rotation body 9$^{v}$, whereas the profiled rib 8 serves for shaping the groove 11 of the finished rotation body 9$^{v}$, said profiled rib 8 having its largest width and lowest height at the beginning of the counteracting pressure surface 1, or where said counteracting surface borders on the feeding zone for feeding the blanks 9 to be worked. Along its course of extension from the beginning of the profiled rib 8 up to its end at the edge of segment 6 of the counteracting surface 1, said edge extending downwardly in view of the direction of rotation of the roll 12 shown in Fig. 1B, said roll being disposed within the counteracting pressure area, the width of profiled rib 8 is constantly decreasing and its height is increasing, said profiled rib 8 ending with a shape matching the shape of the groove 11.

The profiled rib 7, however, which effects the shaping of the shoulder 10 of the finished rotation body, increases in its width and height along its course from the cross section x at the edge of the feeding zone to the cross section x5 at the descending edge of the segment 6, or beginning of the discharge zone for releasing the finished rotation bodies 9$^{v}$.

The center roll 12 shown in Fig. 1B rotates in the space enclosed by the segments 2 to 6 of the counteracting pressure surface, however, it is not shown together with said surface for reasons of providing a superior and clearer general view. The roll 12 is installed in a way such that if the roll 12 is in a position relative to the segments 2 to 6 of the counteracting pressure surface 1 in which the beginnings of the profiled ribs 7 and 8 are radially aligned, said profiled ribs are on the same level.

Figure 2:
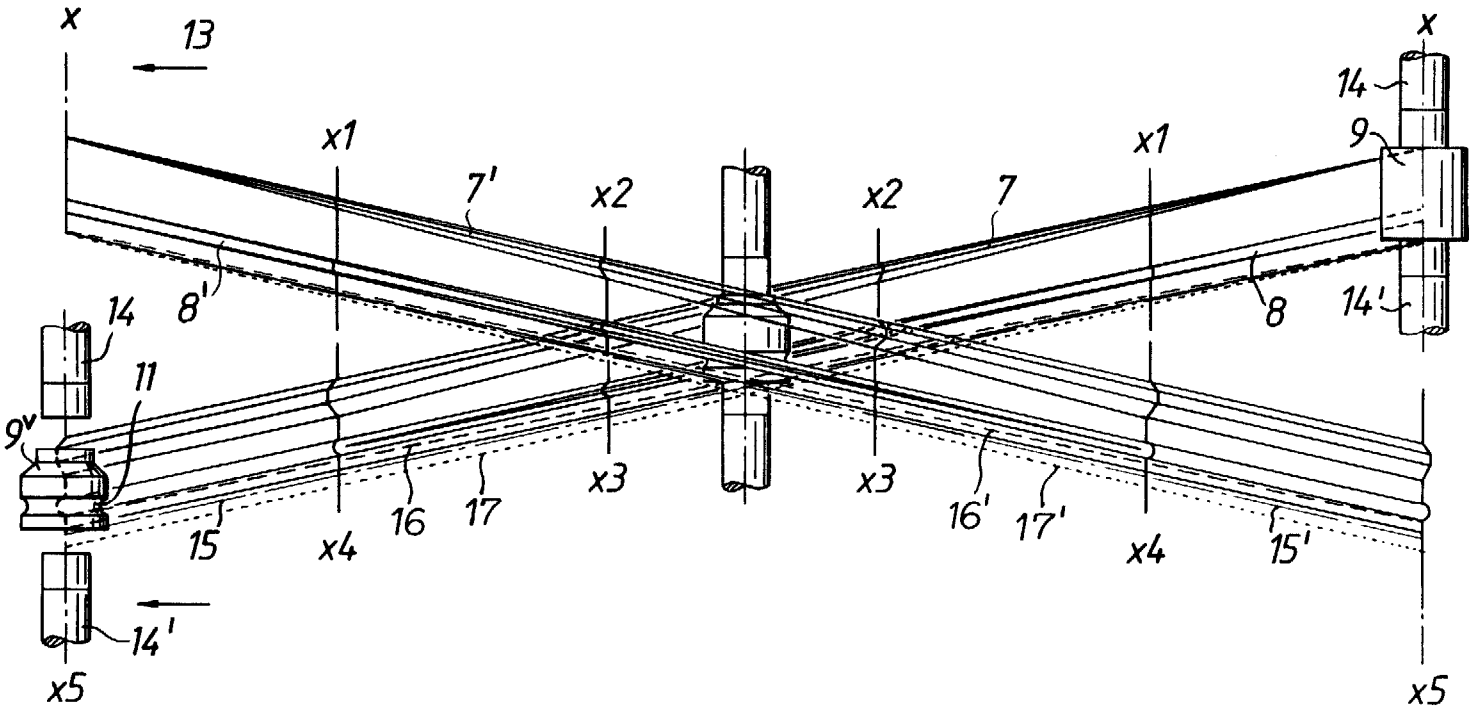
FIG. 2 shows the performance of the profiled ribs of the tools according to FIGS. 1A and 1B.

The cooperation between the two groups of profiled ribs 7 and 8 and 7' and 8', respectively, is best shown in FIG. 2, which shows the performance of the profiled ribs 7 and 8 of the counteracting pressure surface 1 and profiled ribs 7' and 8' of the roll 12. The profiled ribs 7 and 8 descent from the left to the right whereas the profiled ribs 7' and 8' descend from the left to the right. When the roll 12 performs one rotation in the direction of the arrow 13 shown in FIG. 1B, the profiled ribs 7' and 8' are moving against the profiled ribs 7 and 8 in the direction of arrow 13 in FIG. 2.

FIGS. 1B and 2 show that the cross sectional shape of the profiled ribs 7' and 8' changes in the same way as the cross sectional shape of the profiled ribs 7 and 8, i.e the profiled rib 7' widens from cross section x to cross section x5, and the profiled rib 8' decreases in width within the zone of its highest elevation and increases in its height.

Owing to the fact that the profiled ribs of the counteracting pressure surface 1 and roll 12 are arranged inclined in opposite directions and relative to the axis of the roll 12, points of intersection of said profiled ribs are continually produced or established as the roll 12 is rotating. Said points of intersection result in a substantially parallel imaginary line shown by the dash-dotted line 15, which line conforms to the geometric location of the points of intersection of the profiled ribs 8, 8' resulting on rotation of the roll 12 FIG. 2 shows that the blanks 9 are guided parallel to said line 15 between the two tappets 14 and 14', said line 15 being slightly inclined against the profiled rib 8 in order to take into account the growth in length of the blank when the groove is impressed therein.

Owing to the fact that the edge of profiled rib 7 or 7' that is closer to the line 15 encloses with said line an angle, the blank 9, on its course from cross section x to cross section x5, is subjected to a radially acting pressure between the roll 12 and the counteracting pressure surface 1 not only owing to the rising height of the profiled ribs along said course, but also to an axial pressure acting on the shoulder 10 while said shoulder is forming, which axial pressure significantly promotes and facilitates the flow or plastic deformation of the material especially in the axial direction. The change in the shape of the blank 9, which is shown by said blank upon reaching the individual cross sections x to x5, is shown in FIG. 1.

For example, the intermediate product 9' conforms to the state of deformation of the blank 9 as it is present at the borderline x1 between the segment 2 and the segment 3. This is shown by the shape of the cross section of the profiled ribs in said cross section. In the same way, the intermediate product 9'' conforms to the state of deformation of the blank in cross section x2; the intermediate product 9''' conforms to the state of deformation of the blank in cross section x3; and the intermediate product $9'^{v}$ conforms to the state of deformation of the blank in cross section x4. In cross section x5, the blank is completely shaped, forming the finished rotation body $9^{v}$.

The shape of the intermediate products 9', 9'', 9''',$9'^{v}$ and $9^{v}$ clearly shows that the profiled ribs 8 and 8' FIGS. 1A and 1B) each decrease in cross section, whereas the profiled ribs 7 and 7' increase in width.

Fig. 1A, furthermore, shows that while being worked; the blanks 9 are supported between two tappets 14 and 14', said tappets being separated from each other in the feeding and discharge zones, which are disposed between the cross sections x5 and x, thus permitting feeding of the blanks 9 and discharge of the finished rotation bodies 9v, said feeding and discharging operations taking place on different planes disposed perpendicularly to the axis of the roll.

It is particularly shown in FIG. 2 that the profiled ribs 8 and 8' serving for shaping the groove 11 extend substantially parallel to the line 15 and thus parallel to the path traveled by the blanks while being worked between the roll 12 and the counteracting pressure surface 1 The slight inclination of the line 15 relative to the profiled ribs 8, 8' serves for compensating the displacement of the groove toward one face side of the blank while said groove is being formed said shift being caused by the lengthwise growth of the blanks, the impression of the groove.

Figs. 1A to 2 and particularly FIG. 2 show that with the same shape of the profiled ribs and by merely change the angle at which the blank is guided during processing with respect to the line determined during rotation of the roll by the points of intersection of the profiled ribs, it is possible to change the deformation of the blank For example the profiled ribs 8, 8' could be used also for fabricating a spirally extending groove if the blanks 9 are guided with an inclination corresponding to said ribs, for example in accordance with the dotted line 17 in FIG. 2, in which case the angle between the profiled ribs 8, 8' and the path followed by the blanks would determine the pitch of such a spiral groove The only precondition for this would be that the profiled ribs 8, 8' have to be thinner or narrower than the height of the pitch of the groove on the rotation body to be fabricated. If the latter is not the case and the blanks are guided inclined toward the profiled ribs 8 8', a circularly extending groove is formed said groove having a width exceeding the width of the profiled ribs 8 8'. Owing to the pressure applied by the profiled rib 8, 8' to the blank in the axial direction, further compression of the material within the zone of a wall of the groove would be the result.

However, the profiled rib 8, 8' may be used also for shaping a section of the rotation body 9v to be fabricated with a smaller diameter if the angle between the profiled rib 8, 8' and the path in which the blanks 9 are guided between the roll 12 and counteracting surface is selected larger accordingly. For said purpose, the blanks have to be guided only in a path leading upwardly relative to the profiled rib 8, 8', for example along the dashed line 16 in FIG. 2.

In said case, the pressure zones determined by the profiled ribs 8, 8' would be shifted in the axial direction relative to the blank, whereas with the pressure zones determined by the profiled ribs 7, 7' and with guidance of the blanks along line 15 in FIG. 2, only a limitation of the pressure zones in the axial direction relative to the blank would be displaced.

Figure 3:
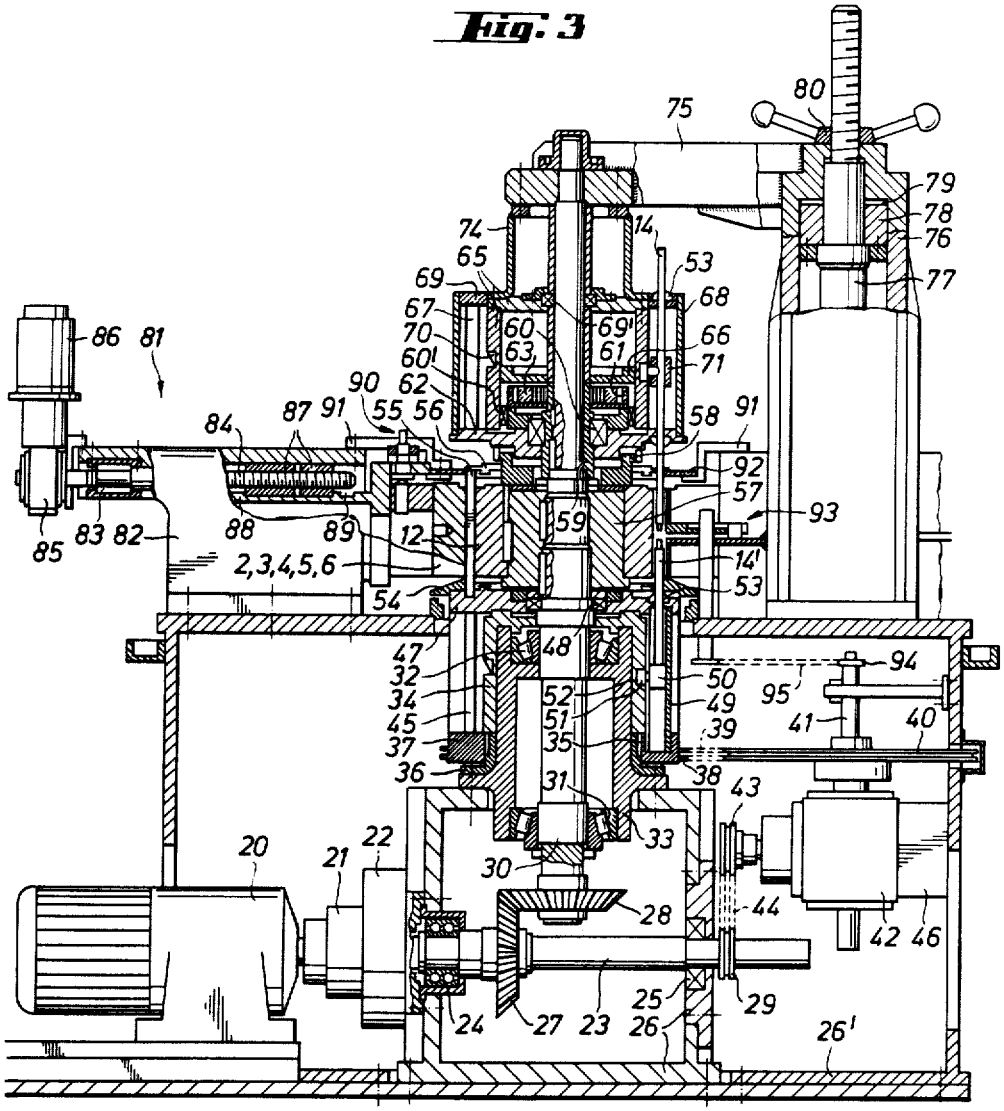
FIG. 3 shows an embodiment of a device for carrying out the process of the invention, said embodiment being shown in a vertical sectional view.

FIG. 3 shows a schematic view of a device for carrying out the process of the invention, said device being shown in a vertical sectional view, the bearings or their installation being shown in a simplified manner. Also, subassemblies consisting of a number parts are shown as one part to some extent for engineering reasons and for reasons of facilitating their installation.

The driving motor 20 drives a shaft 23 by way of a clutch 21, whose one half is connected with a flywheel 22. Said shaft 23 is supported in the conventional manner in the casing 26 by way of the antifriction bearings 24 and 25 and torsionally rigidly connected with a bevel gear 27 and a sprocket wheels 29.

The bevel gear 27 mates with another bevel gear 28, said gear 28 being torsionally rigidly connected with a vertically arranged main shaft 30. The main shaft 30 is supported in a supporting cylinder 33 by means of two tapered roller bearings 31 and 32. Supporting cylinder 33 is connected with the casing 26.

A first guide body 34 is mounted on said supporting cylinder and rigidly connected with the latter. Furthermore, a needle bearing 35 is arranged on said supporting cylinder 33, said needle bearing being fixed in its axial position by the guide body 34 and a support flange 36 and rotatably supporting a rotary body 37 provided with a sprocket rim 38.

Sprocket rim 38 is connected with the sprocket wheels 40 by way of the two chains 39, said sprocket wheels 40 being torsionally rigidly connected with the driven shaft 41 of a gearing 42. Said gearing 42 is driven by sprocket wheels 29 by way of the two chains 44 and the sprocket wheels 43, and supported in the casing 26' by means of a console 46.

The rotary body 37 is connected with another rotary body 47 by way of the bolts 45 and supported on the main shaft 30 by way of an antifriction bearing 48. Said two rotary bodies 37 and 47 are connected with each other by way of the slotted guiding sleeves 49 in which sleeves the tappets 14' and their guiding heads 50 are guided in an axially displaceable manner With their rotatably supported roller 51, said guiding heads 50 engage a controlling groove 52 arranged in the guide body 49.

The tappets 14' extend through the rotary body 47 and are guided therein in bushings 53. Furthermore, a splash ring 54 is secured on the rotary body 47 for draining lubricating oil into a circularly arranged oil sump not shown in the drawing.

The rotary body 47 is connected with another rotary body 56 by means of the supports 55. The rotary bodies 47 and 56 are provided with sections of dovetail guides extending in the tangential direction and serving the purpose of receiving sliding blocks. Said sliding blocks are parts of the driving device shown in FIGS. 8 to 10, 95 explained hereinafter. The corresponding reference numerals are not shown in FIG. 3 for the sake of clarity A chuck body 59 is torsionally rigidly arranged on the main shaft 30 and the roll 12, which is provided with the profiled ribs 7' and 8', is mounted on said chuck body and torsionally rigidly supported on said chuck body by means of a spring-and-groove connection. A toothed rim 58 is joined with the roll 12 by screwing, and a drive is derived from said toothed rim for the driving device, which will be explained in greater detail hereinafter with the help of FIGS. 8 and 10.

Figure 5:
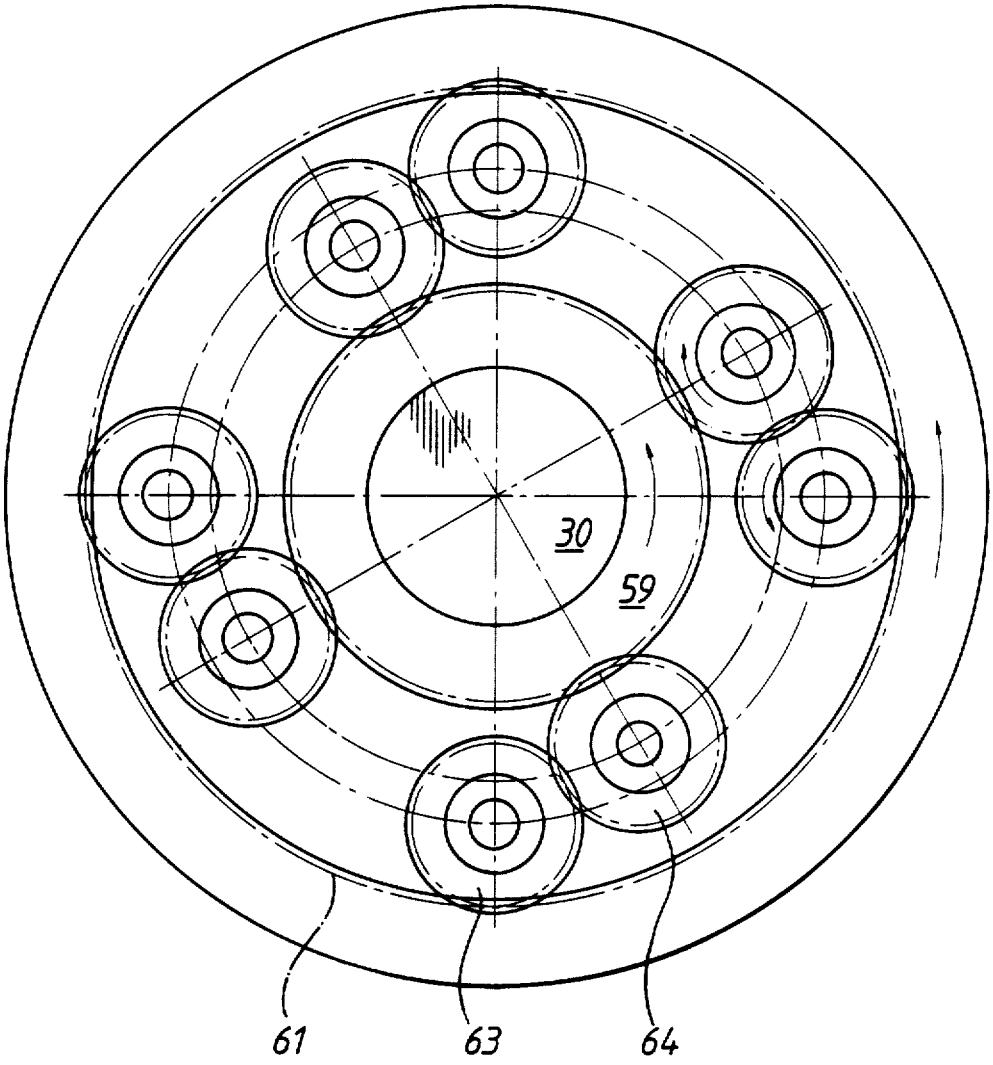
FIG. 5 shows a detail of the device according to FIGS. 3 and in a scaled-up view.

A sleeve 59 is mounted on a segment of the main shaft 30 and torsionally rigidly connected with said shaft by way of a spring-and-groove connection. A rotary body 62, which is joined with an inner toothed rim 61 by screwing, is supported on said sleeve 59 by way of an antifriction bearing 60. FIG. 5 shows that said inner toothed rim 61 is mating with the intermediate gears 63 which, in turn, are mating with other gears 64. Said other gears 64, which only serve for reversing the direction of rotation, are rotatably supported—in the same way as the intermediate gears 63—in a ring 66 arranged in the interior of another guide body 65 rigidly connected on the casing. The gears 64 in turn mate with a toothed rim disposed on the sleeve 59, said toothed rim serving for driving the rotary body 62 by way of the gears 63 and 64 and the toothed rim 61, the latter supporting the guide body 65 by way of an antifriction bearing 60'. The rotary body 62 is connected with a ring 69 by way of the bolts 67 and a sleeve 68, in which ring the bushings 53 are supported in the same way as in the rotary body 62, with the tappets 14 being rotatably and axially displaceably guided in said bushings 53.

Figure 6:
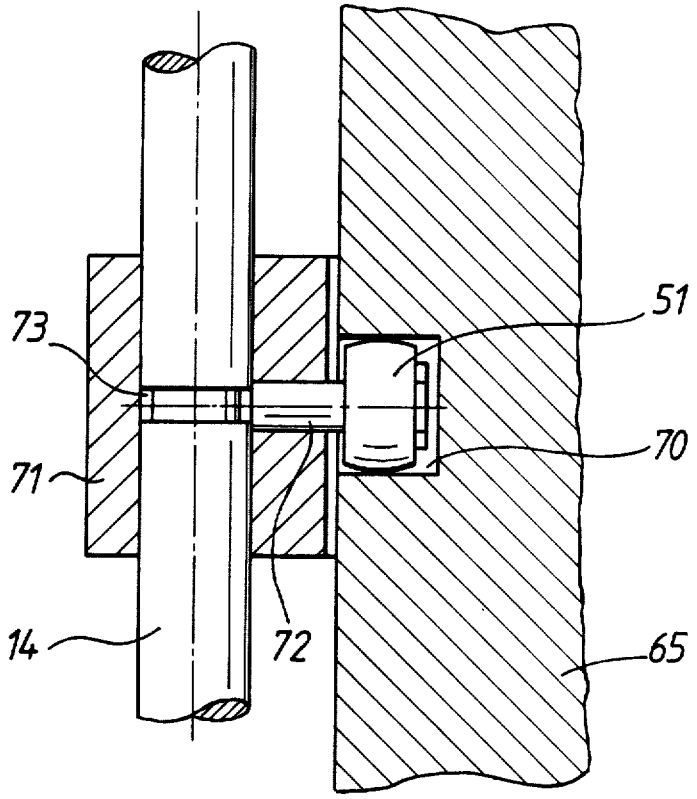
FIG. 6 shows a scaled-up view of a detail of the tappet guidance of the device according to FIGS. 3 and 4.

The guide body 65 consists of two parts and supports the main shaft 30 by way of an antifriction bearing 69'. In addition, the guide body 65 is provided with a controlling groove 70. FIG. 6 shows in a scaled-up view that said controlling groove 70 is engaged by a rotatable roller 51, supported in each guiding head 71 of tappet 14. FIG. 6 shows that an attachment on the pin 72 supporting the roller 51 engages a groove 73 of the tappet 14, said groove extending around said tappet, by which measure said tappet 14 is rotatably supported, but axially fixed in the guiding head 71, i.e., incapable of axial displacement.

The controlling groove 70 extends across the major part of the circumference of the guide body 65 parallel to the controlling groove 52 of the guide body 34. Said parallelism is not present in the feeding and take-off zones explained in connection with FIG. 1A; within said zones, the two controlling grooves diverge and reconverge.

The guide body 65 is connected with a supporting arm 75 by way of a flange body 74; the main shaft 30 is supported in said arm 75 in a friction bearing. The supporting arm 75 is supported on a supporting column 76 secured on the casing 26'. A spindle 77 is arranged in said supporting column 76, which spindle is supported in its top zone on the inside wall of the supporting column 76 by means of a centering ring 78, and supported on the cylindrical bore 79 of the supporting arm 75. The supporting arm 75 is held on supporting column 76 by means of a nut 80. After unscrewing and removing the nut 80 and disconnecting the flange body 74 from the supporting arm 75 said supporting arm may be lifted and swiveled, permitting the device to be dismantled, for example for the purpose of exchanging the roll 12 for a roll with differently shaped profiled ribs for fabricating different types of rotation bodies.

Furthermore, five carriages 81 supporting the segments 2 to 6 of the counteracting surface 1 are mounted on the casing 26'. Said carriages are guided in the casings 82; a threaded spindle 84 supported in a bearing arrangement consisting of axial and radial antifriction bearings is arranged in each of said casings 82. Said spindle 84 is driven by a stepping motor 86 by way of a gearing 85 and extends through two nuts 87, tightened against each other for compensating the thread play or clearance, and in turn connected with the carriage body 88, which is guided in the casing 82 and which has a recess 89 for receiving a strain gauge.

A level or height support is guided on the end face of the carriage body 88 and, together with the associated set spindle, is identified by reference numeral 90 One segment of the counteracting surface 1 supporting the profiled ribs 7 and 8 is fastened on sad level support 90.

A circularly extending coulisse 92 is supported on the carriages 81 and the supporting column 76 by way of the supporting arms 91 Said coulisse is provided for controlling the driving device and explained hereinafter in greater detail with the help of FIGS. 8 and 9.

Figure 4:
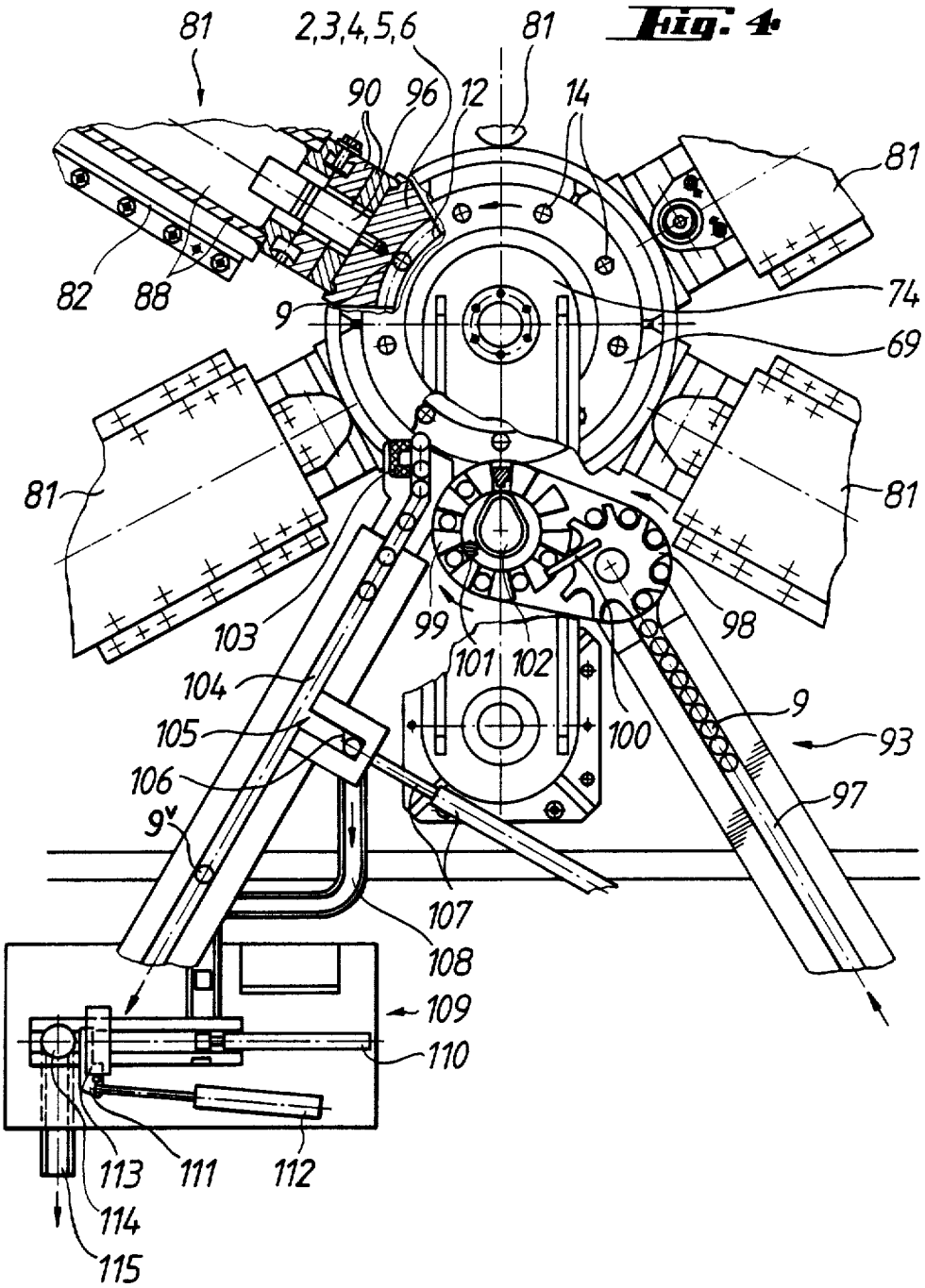
FIG. 4 is a top view of the device according to FIG. 3.

The device for feeding the blanks to be deformed, which device is shown more clearly in FIG. 4, is identified in its entity by reference numeral 93; said device is driven by the gearing 42 by way of a sprocket wheel 94 and a chain 95.

The transmission ratio of the gearing 42 and the sprocket wheels 40 and 38 as well as the one of the toothed rim 61 and of the toothed rim of the sleeve and the transmission ratio of the gearing formed by the gears 63 and 64 has been selected in such a way that the rotary bodes driven by said gearings, in the path described by the tappets 14, 14', which are supported by said rotary bodies, are driven at half the circumferential speed of the surface of the roll supporting the profiled ribs.

As shown in a sectional view of carriage 81 in FIG. 4, an oscillator 96 is screwed into the segment of the counteracting surface 1, which oscillator oscillates said counteracting pressure surface with high-frequency vibrations, thus facilitating the deformation of the blanks 9, the latter being guided between the segments of the counteracting pressure surface 1 and the roll 12 by means of a driving device not shown in FIG. 4 for the sake of better clarity.

FIG. 4 shows, furthermore, the feeding system 93, which has an inclined chute 97 for guiding the blanks 9 to a star wheel 98. Said star wheel 98 transports the blanks to another star wheel 99, a baffle plate 100 being provided for transferring the blanks. Said plate 100 is secured on a holder which, in turn, is fastened on the casing 26'. The holder is not shown for the sake of clarity of the figure.

The plungers 101, of which only two are shown, are guided in the star wheel 99, said star wheel revolving on a plane which is slightly displaced with respect to star wheel 98. Said plungers project beyond the top face of the star wheel 99 and slide along the cam 102. Said cam, which is not moving, effects the ejection of the blanks 9 into the path of the tappets 14, 14', by which the blanks are seized or clamped.

A magnet 103 is arranged on a horizontal plane which is different from the one of the feeding system. On release of the finished rotation bodies $9^v$ by the tappets 14, 14', said magnet guides said finished bodies into another chute 104.

A switch 105 is installed in the chute 104. By means of said switch, a rotation body may be selectively pulled out by pushing in a baffle plate 106 by means of a piston-and-cylinder arrangement 107, and the rotation body so pulled out is then passed to a measuring device 109 by way of a chute 108. In said measuring device, the rotation body $9^v$ is pushed into a measuring position by the piston 110, in which position said body rests against a stop means 111 which is pivotal by means of the piston-and-cylinder arrangement 112. The measurement as such is carried out by means of an optical measuring head 113, which emits the result of the measurement in the form of electric signals, which signals are supplied to a controlling device (not shown), for example a process computer If the measured values so determined approach the limits of a given field of tolerances, said computer emits control commands transmitted to the stepping motors 86 of the carriages 81 in order to adjust said carriages accordingly. In this way, it is possible to maintain very close tolerances.

After the rotation body $9^v$ has been measured, the stop means 111 is swiveled by the piston-and-cylinder arrangement 112, and the piston-and-cylinder arrangement 110 advances the measured rotation body to the opening 114, through which said body then slides out by way of the chute 115.

Figure 7:
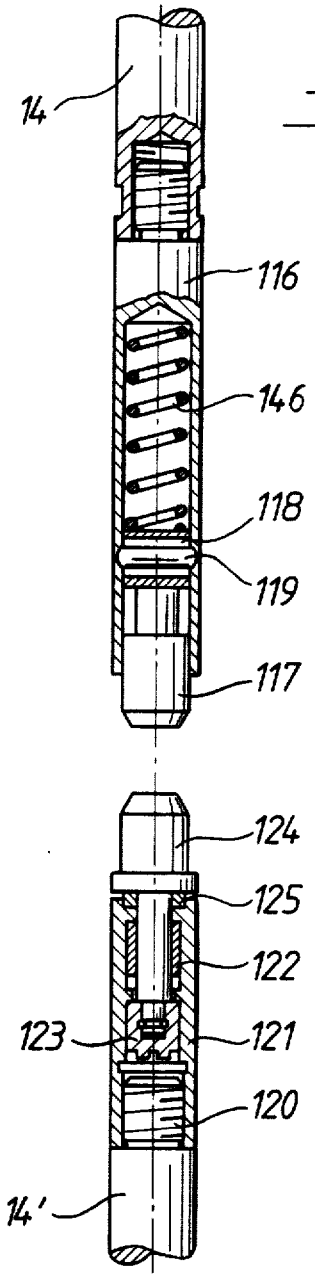
FIG. 7 shows another detail of the tappets.

FIG. 7 shows the end zones of the tappets 14 and 14' in a scaled-up view, said end zones being rotatable around the longitudinal axis of the tappets. An insert 116 is screwed in the end face of the tappet 14, and a tip 117 is supported in said insert by means of a pin 119 extending through the transverse bore 118 of the tip 117 and also through the walls of the insert 116. Said tip 117 is supported axially slidably in the insert 116 and acted upon by a spring 146. Owing to the fact that the transverse bore 118 has a larger diameter than the pin, said tip 117 is slightly displaceable axially relative to the insert. This permits compensating minor dimensional variations of the blanks 9 and compensating the lengthwise growth of the blanks while being worked or deformed by the profiled ribs 7 and 8 and 7' and 8' of the counterpressure surface 1 and roll 12, respectively.

A sleeve 121 is screwed on the threaded pin 120 of the tappet 14', and a sliding bushing 122 is inserted in said sleeve and secured by an insert piece 123. A tip 124 is rotatably supported in said sliding bushing 122, the collar of said tip being supported on a sliding ring 125 which, in turn, is supported on a shoulder of the sleeve 121.

The rotatable tip 124 of the tappets 14' and the rotatable mounting of the tappets 14 in their guiding heads 71 assure that friction is avoided between the tappets 14, 14' and between the blanks 9 supported between said tappets.

Figure 8:
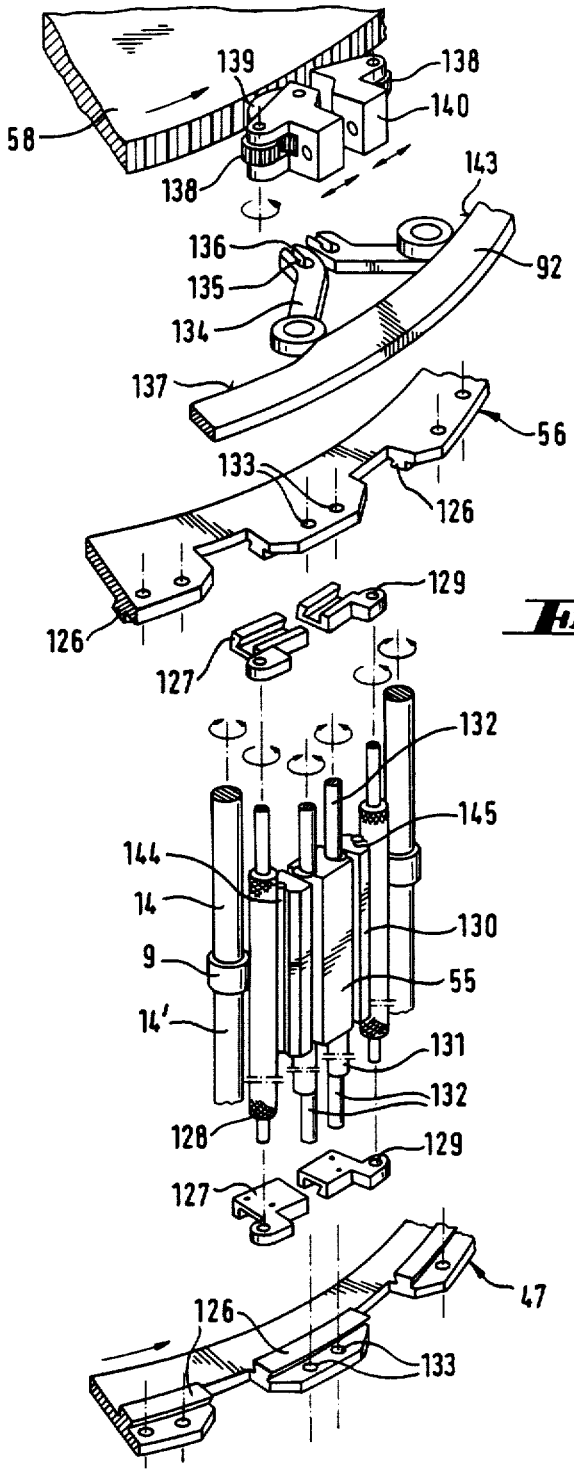
FIG. 8 is an exploded view of the driving device of the device according to FIGS. 3 and 4.
Figure 9:
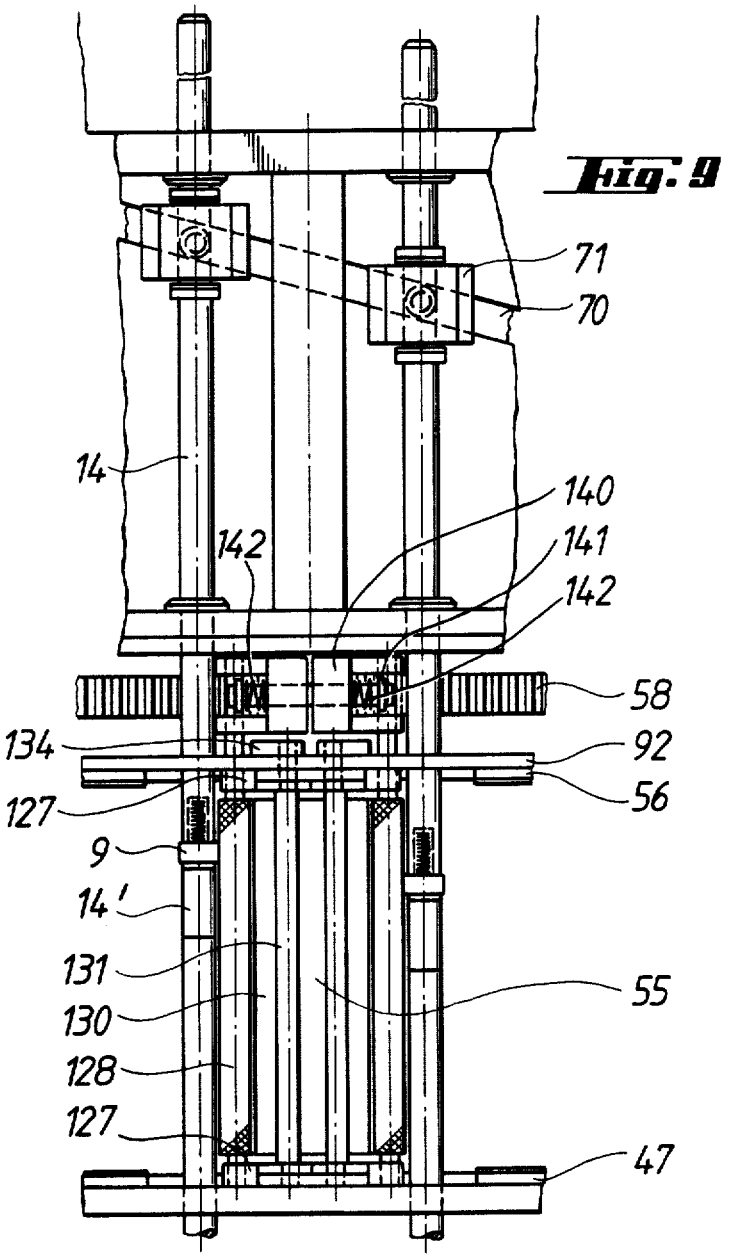
FIG. 9 is a view of the driving device.
Figure 10:
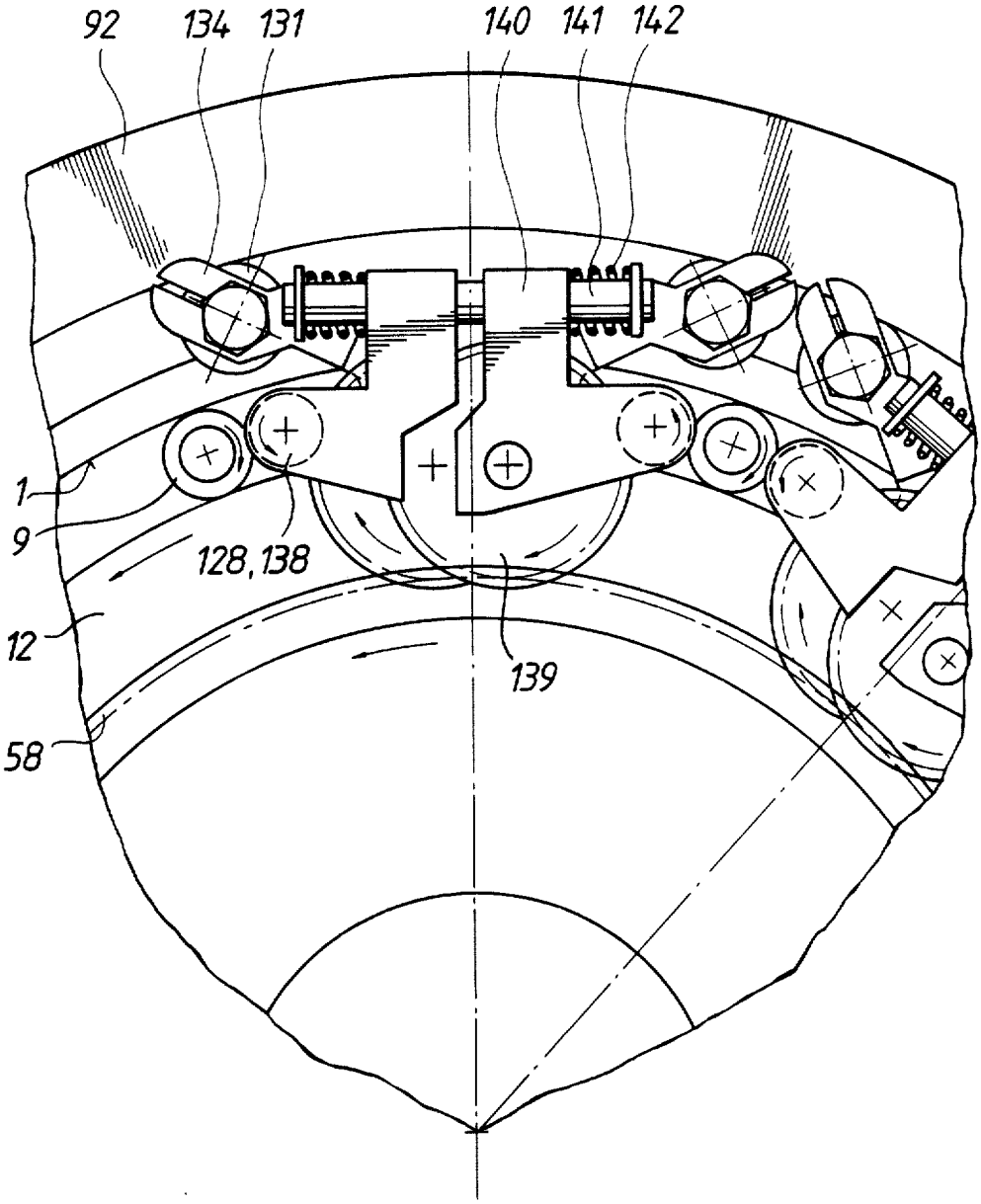
FIG. 10 shows a top view of the driving device.

The driving device is explained in greater detail with the help of FIGS. 8, 9 and 10:

The rotary bodies 47 and 56 are provided in sections with tangentially extending, radially projecting dovetail guides 126. Two sliding blocks 127 are displaceably arranged on each of the sections of said dovetail guides. The tappets 14 and 14' extend between the attachments of the rotary bodies, whereas the supporting rollers 128 are rotatably supported in the bores 129 of the sliding blocks 127. The sliding blocks 127 supported in the different sections of rotary bodies 47 and 56 are connected with each other by way of the pressure bodies 130, the latter being screwed to slide blocks 127. Each of the pressure bodies 130 is controlled by a camshaft 131 whose axial, cylindrical attachments 132 extend through the bores 133 and are rotatably supported in said bores, said bores being arranged in the radially projecting attachments of the rotary bodies 47 and 56. The top cylindrical attachments 132 each are torsionally rigidly clamped in a control lever 134, the attachments 132 engaging the bores 135, which bores delimit slots 136. Upon rotation of the two rotary bodies 47 and 56, said control levers 134 slide along the stationary coulisse 92.

Said coulisse 92 substantially describes a circular arc across the range of the arc over which the counteracting pressure surface 1 is extending. Within the feeding and take-off zones for the blanks and finished rotation bodies 9 and 9v, respectively, said coulisse 92 has a recess 137, which permits the control levers to swivel.

The supporting rolls 128 have a zone provided with a flanging, said flanging coming into contact with the blanks 9 and driving said blanks. The supporting rolls are driven by the gears 138, which are torsionally rigidly connected with said supporting rolls. Said toothed gears 138 mate with the intermediate gears 139, said gears 139 each being rotatably supported in a support 140 together with one of the gears 138, whereby the intermediate gears 139 mate with the toothed rim 58, said rim being connected with the roll 12 supporting the profiled ribs 7', 8'. Owing to the difference in speed between the toothed rim 58 and the supports 140, which supports are jointly moving due to the positive connection with the rotary bodies 47 and 56, said positive connection being assured by the supporting shafts 128, said intermediate gears are caused to rotate, thus driving the supporting shafts.

FIGS. 9 and 10 show that the supports 140, of which two are associated in each case, are connected with each other by means of a bolt 141, the two supports 140 being braced together by means of two springs 142.

As long as the control levers 134 slide along the circular arc-shaped range or zone of the coulisse 92, said levers are deflected, and the camshafts 131, which are torsionally rigidly connected with said levers, force the rotary bodies 130 and the supporting shafts 128—said supporting shafts being supported in the sliding blocks 127 together with said rotary bodies—against the tappets 14, 14', and thus against the blanks 9 to be deformed. At the same time, the supports 140 are forced apart against the tension of the springs 142. When one of the control levers 134 slides into recess 137 in the coulisse, it is capable of giving way, and the springs 142 are capable of pushing the supporting shafts 128 away from the tappets, which, due to the swiveling motion performed by the camshaft 131, causes the control lever 134 to perform a swiveling motion as well, said lever 134 being kept in contact with the coulisse 92 by the springs 142.

FIG. 10 shows that the intermediate gears 139 rotate on two different horizontal planes; on their one side, each of said gears is rotatably secured in axle journals supported in the associated support 140. The transmission ratio of the gearings 58, 139, 138 and the diameter of the supporting shaft 128 within the flanged range are adapted to each other in such a way that the circumferential speed of the flanged zone of the supporting shafts 128 and thus also the circumferential speed of the blanks 9 resting against said shafts is equal the circumferential speed of the surface of the roll 12 supporting the profiled ribs. Although the blanks 9 are rotated or caused to rotate alone by rolling on the stationary counteracting pressure surface 1 and the surface of the roll 12, as this is shown in FIG. 10 by arrows, sliding of the blanks on said surfaces may occur in the course of processing or deformation work. Such sliding is prevented by additionally driving the blanks by means of the supporting shafts, each blank 9 being supported and driven between the supporting shafts 128, said shafts being supported in adjacent pairs of supports 140, as shown in FIG. 10.

FIG. 8 shows that the pressure bodies 130 have a groove facing the supporting shafts 128. Said groove extends in the axial direction, and rolling bodies are supported in said grooves, said bodies projecting beyond the outer or outward edges of the groove 145. In this way, friction between the supporting shafts and the pressure bodies 130 is largely prevented.

When the control levers 134 change from the circular zone of the coulisse 92 into its recess, an additional motion of the intermediate gears 139 relative to the toothed rim 58 is initiated due to the fact that the two supports 140, said supports being connected with the bolt 141, approach each other owing to the action of the springs 142. Said additional motion results in a change in the number of revolutions of the supporting shafts; however, said change in speed is insignificant because the supporting shafts 128 move away from the blank 9.

Within the zone covered by the counteracting pressure surface 1, the controlling grooves 52, 70—which determine the path of the blanks 9—extend in accordance with line 15 in FIG. 2, or parallel to said line. Outside of said zone or range, the course of the controlling grooves has oppositely directed bulges, causing the rotating controlling grooves 52, 70 to further move away from each other and to approach each other again, so that the blanks 9 or the rotation bodies 9v cannot jam or become wedged within said zone, permitting smooth feeding of the blanks and discharge of the finished rotation bodies.

Of course, within the zone conforming to the counteracting pressure surface 1, the controlling grooves 52, 70 may have a configuration deviating from the line 15 in FIG. 2; by way of example, their configuration may be parallel to line 16 or line 17 in FIG. 2. This depends on the shape of the rotation bodies 9v to be fabricated and on the design of the profiled ribs 7, 8; 7', 8'.

In the embodiment shown in the drawing, the counteracting pressure surface has a curvature conforming to the one of the roll 12. However, such conformity is not necessarily required. For example, a plane counteracting pressure surface may be provided, across which the roll is moving, and it is of no consequence whether the counteracting pressure surface is moved or driven relative to the axle of the roll or said roll is driven parallel to the counteracting pressure surface.

What is claimed is:

1. A process of fabricating a rotation body having different diameters along the length thereof, which comprising the steps of:

(a) rotating a blank about the longitudinal axis thereof and working the rotating blank between two pressure zones to apply thereto a local pressure exceeding the flow limit of the blank material whereby circularly extending impressions of the different diameters are worked into the blank, the pressure zones crossing each other, (b) displacing the pressure zones relative to each other while applying the local pressure, one of the pressure, one of the pressure zones being displaced in a direction at an angle to its longitudinal extension and the longitudinal direction of the pressure zone it crosses and the points of crossing of the crossing pressure zones forming a geometric line at an angle to the longitudinal axis, and (c) displacing the blank in dependence on said line and on the different diameters to be produced.

2. The process of claim 1, wherein the blanks are displaced substantially parallel to said line whereby parallel circumferential grooves are worked into the blank.

3. The process of claim 1, wherein the blanks are displaced at an angle to said line to work a spirally extending groove into the blank, the angle of displacement corresponding to the desired pitch of the spirally extending groove and the pitch exceeding the width of the pressure zones.

4. The process of claim 3, wherein the spirally extending groove forms a screw thread and the blank has a diameter corresponding to the outer diameter of the screw thread.

5. The process of claim 1 for fabricating a rotation body having at least two circularly extending impressions of different diameters, wherein the crossing pressure zones have at least sections narrower than the circularly extending impression of smaller diameter, and the blanks are displaced along lines inclined with respect to said geometric line, the width of the pressure zones exceeding the difference between the inclinations of said inclined lines during one rotation of the blank.

6. The process of claim 1, wherein the crossing pressure zones are displaced in direction having a component extending parallel to the longitudinal axis to reduce the diameter of the blank along an axial section thereof, the pressure zones having a smaller dimension in the axial direction of the blank than the reduced diameter blank section.

7. The process of claim 1, wherein the pressure zones are displaced relative to each other by holding one of the pressure zones fixedly and the other pressure zone is moved while applying the local pressure to the blank, the other pressure zone being moved in a direction at angle to its longitudinal extension and to the longitudinal direction of the fixed pressure zone.

8. A machine for fabricating a rotation body having different diameters along the length thereof from a rotating blank, which comprises:

(a) a roll having at least one radially projecting profiled rib, (b) a counteracting pressure surface cooperating with the roll and remaining in a constant position relative to the roll in an axial direction, the pressure surface having at least one radially projecting profiled rib crossing the rib on the roll, (c) means for rotating the roll about the longitudinal axis thereof relative to the counteracting pressure surface whereby the displacement motion between the roll and the counteracting pressure surface has a component extending circumferentially about the roll and the points of crossing of the crossing ribs form a geometric line at an angle to the longitudinal axis, and (d) guide means for displacing the blank relative to said line in the axial direction in dependence on the different diameters to be produced while the blank is rotated and subjected to pressure exceeding the flow limit of the blank material between the roll and the pressure surface.

9. The machine of claim 8, wherein the guide means extends substantially parallel to said line whereby parallel circumferential grooves are worked into the blank.

10. The machine of claim 8, wherein the guide means extends at an angle to said line to work a spirally extending groove into the blank, the angle corresponding to the desired pitch of the spirally extending groove.

11. The machine of claim 8, each one of the crossing profiled ribs is inclined with respect to the longitudinal axis of the roll.

12. The machine of claim 8, for fabricating a rotation body having a circularly extending zone of reduced diameter, wherein the guide means extends in a direction inclined with respect to said geometric line whereby there is a difference in the distance between the guide means and the geometric line at the beginning and at the end of one rotation of the blank, as measured in the direction of the longitudinal axis, said distance being smaller than the width of the profiled ribs and the difference in said distance at a feeding zone of the blank to the cooperating roll and counteracting pressure zone and at a discharge zone of the fabricated rotation body corresponding to the length of the zone of reduced diameter of the rotation body.

13. A machine for fabricating a rotation body having different diameters along the axial length thereof from a rotating blank, which comprises:

(a) a roll having a longitudinal axis, (b) a counteracting pressure surface cooperating with the roll, (1) the pressure surface and the roll having a radially projecting profiled rib, the profiled ribs being inclined with respect to the longitudinal axis of the roll and crossing each other, (c) means for rotating the roll about the longitudinal axis thereof and applying to the rotating blank between the roll and the pressure surface a local pressure exceeding the flow limit of the blank material to reduce the diameter of the blank along an axial section thereof by displacing each rib in a direction parallel to the longitudinal axis, each rib having a smaller dimension in the axial direction of the blank than the reduced diameter blank section whereby the displacement motion between the roll and counteracting pressure surface has a component extending circumferentially about the roll and the points of crossing of the crossing ribs form a geometric line, and (d) guide means for displacing the blank inclined with respect to said line.

14. The machine of claim 13, wherein the roll is arranged centrally with respect to the cooperating counteracting pressure surface, and the inclination of the guide means with respect to said geometric line causing a difference in the distance between the guide means and the geometric line at the beginning and at the end of one rotation of the blank, as measured in the direction of the longitudinal axis, said distance being smaller than the width of the profiled ribs and the difference in said distances at a feeding zone of the blank to the cooperating roll and counteracting pressure zone and at a discharge zone of the fabricated rotation body corresponding to the length of the zone of reduced diameter of the rotation body.

15. The machine of claim 14, wherein the counteracting pressure surface is comprised of segments radially displaceable relative to the roll.

16. The machine of claim 13, wherein the guide means for displacing the blank comprises an entrainment device including two axially spaced rotary bodies, a respective tappet displaceable in a longitudinal direction thereof in a respective one of the rotary bodies, a respective fixed circumferential control groove receiving a sliding block means connected to the respective tappet, the tappets being axially aligned and extending substantially parallel to the longitudinal axis of the roll, and the blank being capable of being clamped between the tappets.

17. The machine of claim 16, wherein at least the facing ends of the aligned tappets are rotatable about the axes thereof.

18. The machine of claim 16, wherein the end of one of the aligned tappets facing the end of the other tappet is coaxially biased towards the same.

19. The machine of claim 16, wherein the entrainment device further comprises a toothed rim rigidly connected to the central roll for rotation therewith, gears in driving connection with the toothed rim, the gears being supported by shafts extending parallel to the tappets and the supporting shafts being held in the respective rotary bodies.

20. The machine of claim 16 wherein the control grooves extend substantially parallel to each other, except for a feeding zone of the blanket and a discharge zone for the rotation body.

21. A machine for fabricating a rotation body having different diameters along the length thereof from a rotating blank, which comprises:

(a) a roll having at least one radially projecting profiled rib, (b) a counteracting pressure surface comprised of segments radially displaceable relative to the roll, the counteracting pressure surface cooperating with the roll and remaining in a constant position relative thereto in an axial direction, the pressure surface having at least one radially projecting profiled rib crossing the rib on the roll, (c) means for rotating the roll about the longitudinal axis thereof relative to the conuteracting pressure surface whereby the displacement motion between the roll and the counteracting pressure surface has a component extending circumferentially about the roll and the points of crossing of the crossing ribs form a geometric line at an angle to the longitudinal axis, (d) guide means for displacing the blank relative to said geometric line in the axial direction in dependence on the different diameters to be produced while the blank is rotated and subjected to pressure exceeding the flow limit of the blank material between the roll and pressure surface, the guide means extending substantially parallel to said geometric line whereby parallel circumferential grooves are worked into the blank.

22. The machine of claim 21, further comprising carriages radially slidable relative to the roll and carrying the counteracting pressure surface segments, and control drive means for independently sliding the carriages.

* * * * *